US008099990B2

(12) United States Patent
Mittermayr

(10) Patent No.: US 8,099,990 B2
(45) Date of Patent: Jan. 24, 2012

(54) ROLL CHANGING DEVICE WITH WEDGE ADJUSTING DEVICE

(75) Inventor: Günter Mittermayr, St. Florian (AT)

(73) Assignee: Siemens Vai Metals Technologies GmbH (AT)

( * ) Notice: Subject to any disclaimer, the term of this patent is extended or adjusted under 35 U.S.C. 154(b) by 259 days.

(21) Appl. No.: 12/514,663

(22) PCT Filed: Oct. 1, 2007

(86) PCT No.: PCT/EP2007/008513

§ 371 (c)(1),
(2), (4) Date: May 13, 2009

(87) PCT Pub. No.: WO2008/058595

PCT Pub. Date: Mar. 22, 2008

(65) Prior Publication Data

US 2010/0077824 A1 Apr. 1, 2010

(30) Foreign Application Priority Data

Nov. 16, 2006 (AT) ..... A1900/2006

(51) Int. Cl.
*B21B 31/30* (2006.01)

(52) U.S. Cl. ..... 72/244; 100/168

(58) Field of Classification Search ..... 72/244, 72/450–451, 237–239, 245–248; 100/168, 100/175, 176

See application file for complete search history.

(56) References Cited

U.S. PATENT DOCUMENTS

| | | | | |
|---|---|---|---|---|
| 4,237,715 | A * | 12/1980 | Lutz | 72/244 |
| 4,736,609 | A | 4/1988 | Schiller et al. | |
| 4,751,837 | A * | 6/1988 | Bohnenkamp | 72/239 |
| 4,793,405 | A | 12/1988 | Diggelmann et al. | |
| 5,479,809 | A * | 1/1996 | Stachuletz et al. | 72/244 |
| 2009/0064750 | A1 * | 3/2009 | Denker et al. | 72/240 |

FOREIGN PATENT DOCUMENTS

| | | | |
|---|---|---|---|
| DE | 22 41 833 | A1 | 3/1974 |
| DE | 25 13 666 | A1 | 10/1976 |
| DE | 28 06 525 | A1 | 8/1979 |
| EP | 0 212 433 | A2 | 3/1987 |
| EP | 0 231 456 | B1 | 5/1987 |
| EP | 0 231 445 | A | 8/1987 |
| EP | 0 513 946 | A | 11/1992 |

(Continued)

OTHER PUBLICATIONS

International Search Report dated Dec. 7, 2007, issued in corresponding international application No. PCT/EP2007/008513.

(Continued)

*Primary Examiner* — Jimmy T Nguyen
(74) *Attorney, Agent, or Firm* — Ostrolenk Faber LLP

(57) ABSTRACT

A roll changing device with a steplessly operating wedge adjusting device that operates on the roll chocks of a roll that is supported on the stand uprights and which roll is to be replaced by another in the chocks in a roll stand. The adjusting wedge has a continuously planar wedge surface area. The wedge adjusting device includes a clamping device for fixing the position of the adjusting wedge relative to a stand for the roll chocks. An upper pressure plate in the stand and above the wedge and the roll chock is vertically and horizontally guided in the roll changing device.

12 Claims, 2 Drawing Sheets

FOREIGN PATENT DOCUMENTS

| | | | |
|---|---|---|---|
| GB | 1 439 005 | | 6/1976 |
| JP | 59 087912 | A | 5/1984 |
| JP | 61063309 | A | 4/1986 |
| JP | 02 037905 | A | 2/1990 |
| JP | 07-265919 | A | 10/1995 |
| RU | 2131314 | C1 | 6/1999 |
| SU | 167783 | | 11/1965 |
| SU | 626844 | | 8/1978 |

OTHER PUBLICATIONS

Russian Office Action, dated Jul. 11, 2011, issued in corresponding Russian Patent Application No. 2009122695/02 (031356), total 4 pages.

* cited by examiner

ROLL CHANGING DEVICE WITH WEDGE ADJUSTING DEVICE

CROSS REFERENCE TO RELATED APPLICATION

The present application is a 35 U.S.C. §§371 national phase conversion of PCT/EP2007/008513, filed Oct. 1, 2007, which claims priority of Austrian Application No. A1900/2006, filed Nov. 16, 2006, the disclosure of which is incorporated by reference herein. The PCT International Application was published in the German language.

BACKGROUND OF THE INVENTION

The invention relates to a device for changing the height of rolls in rolling stands and for carrying out a roll change. This device uses a wedge adjusting device for bringing the lower work roll into line with a rolling line. The device comprises an adjusting wedge, which can be displaced in the longitudinal direction of the rolls and has a continuously planar wedge surface area. A displacing device is connected to the adjusting wedge. A clamping device fixes the adjusting wedge. A roll changing device changes the rolls. That device can be moved in the longitudinal direction of the rolls. The rolls are supported at their ends in roll chocks and are guided with adjustable height in stand uprights arranged in parallel. Each of the two roll chocks is supported in the stand upright by means of an upper pressure plate, the adjusting wedge and a lower pressure plate.

It is known to bring the upper edge of the lower work roll into line with the rolling line by means of adjusting plates of different heights, which are chosen according to the respective degree of compensation. These plates are moved in and out together with the chocks from a roll changing carriage. A major disadvantage is that, for each degree of compensation, a pair of these adjusting plates must be kept on standby, their handling is difficult and it is only possible to bring the lower work roll into line with the rolling line within the range of graduation of the adjusting plate thickness.

EP 0 513 946 A2 already discloses a wedge adjusting device for bringing the upper edge of the lower work roll into line with the rolling line. Two respectively interacting wedges are formed in a step-shaped manner and form horizontal supporting faces, which determine the position of the lower work roll in relation to the rolling line by the displacement position assumed by the wedges. With such a stepped wedge, however, stepless adjustment of the work roll to the rolling line cannot be achieved, but rather only an approximate approach to the rolling line is possible, dependent on the step height. The lower wedges are connected by means of traction elements and are equipped with a motorized adjusting drive. The upper wedge elements are fixed in cross members, on which the chocks of the rolls are supported. To adapt the work rolls to the rolling line, each of the cross members is raised by four pressure-medium cylinders in each case, and the lower wedge elements are correspondingly displaced horizontally. This adjusting operation consequently requires the complex use of many adjusting devices together. For the roll change, the chocks are assigned wheelsets, which can be lowered onto lateral guide rails, arranged alongside the large-area cross members, and can then be moved out in the axial direction of the rolls. The lowering movement takes place by means of the wedge adjustment. A particular disadvantage of this structural design is the larger structural width of the devices within the roll stand.

DE 25 13 666 A1 likewise discloses a rolling stand in which the chocks carrying work rolls and back-up rolls are assigned running wheels. The chocks can consequently be lowered on guide rails and moved out of and into the roll stand in the axial direction of the rolls. For positioning the lower work roll onto the rolling line, a wedge adjusting device is provided, comprising two wedges acting in opposite directions and having assigned drive spindles. Arranged laterally next to the adjusting wedges on both sides are lifting cylinders, with which the chocks can be raised for actuating the wedge adjusting device and can be released after lowering, so that the chocks are supported in the stand frame exclusively by means of the wedge adjusting device. This embodiment also requires a relatively large installation width.

The solution known from EP 0 231 445 A1 also uses the principle of stepped plates for an approximate adjustment of the work roll in relation to the rolling line, in that stepped plates of different heights are arranged in a displacement frame and, after raising of the roll chocks by means of a lifting cylinder, can be positioned under them. Stepless fine adjustment takes place by means of a wedge arrangement, which comprises two wedges engaging in each other, the lower wedge being displaced by a horizontally acting adjusting cylinder and the second wedge, resting on the first, and consequently the stepped plates, being raised vertically. According to a further embodiment, the stepped plate arrangement is reduced to a stepped plate with only one height, so that a selective approximate adjustment is only possible by manually changing the stepped plate. The two wedge adjusting devices and the lifting cylinders are structurally integrated in the roll changing carriages and are displaced together with the roll changing carriage during a roll change. A major disadvantage of this structural design is the provision of two independent adjusting devices, whereby the overall structural height of the roll changing device increases.

JP 07-265919 A discloses a wedge adjusting device with an adjusting wedge with two planar wedge surface areas for adjusting the lower work roll to the adjustment line. A roll changing device is not described or shown, and so this document also does not disclose any information regarding any structural and functional interaction of these components.

It is also the case with the device known from DE 28 06 525 A1 for bringing the upper edge of the lower work rolls into line with the rolling line that adjusting pieces of different heights that are kept in a displacement frame are selectively pushed under the roll chocks after said roll chocks have been raised. This solution once again does not allow the work roll contour to be steplessly made to approach the rolling line. The displacement frame for the adjusting pieces is arranged displaceably on the moving-out carriage for the set of rolls. The lifting devices for the roll chocks are also integrated in the moving-out carriages.

SUMMARY OF THE INVENTION

The object of the present invention is therefore to avoid the disadvantages of the prior art described and to propose a roll changing device with a steplessly operating wedge adjusting device that is distinguished by a particularly compact structural size and is therefore specifically suitable for conversions of existing rolling stands. A further advantage is that there is no longer any need for lifting cylinders that were previously necessary for the actuation of the wedge adjusting device, for raising the roll chocks, and consequently a significant simplification of the device is achieved.

This object is achieved on the basis of a device of the type described at the beginning by the wedge adjusting device being structurally separate from the roll changing device and by the upper pressure plate being vertically and horizontally guided in the roll changing device. The wedge surface area is in this case inclined and step-free. The structural separation makes separate functionality of the wedge adjusting device and the roll changing device possible.

The adjusting wedge is preferably formed here in such a way that the wedge surface area of the adjusting wedge has an inclination ensuring self-locking.

The wedge surface areas on the adjusting wedge are preferably inclined in relation to the horizontal plane at an angle which lies in the self-locking range of the wedge connection. The wedge angle is preferably 4 to 6°. Within this angle range, adjusting forces are obtained for the raising or lowering of the work rolls, and possibly back-up rolls, together with the associated roll chocks and can be applied by the displacing device.

According to a preferred embodiment, the displacing device for actuating the adjusting wedge is formed by a pressure-medium cylinder and the clamping device for fixing the adjusting wedge acts in a clamping manner on the piston rod of the pressure-medium cylinder. For determining the exact position of the adjusting wedge, the displacing device is assigned a device for position determination or displacement tracking, a pressure-medium cylinder with integrated linear displacement measurement preferably being used. This definitely ensures that the performed positioning of the lower work roll in relation to the rolling line can also be maintained during operational loads. The pressure-medium cylinder for actuating the adjusting wedge is preferably supported in a fixed location on the foundation of the plant.

The adjusting wedge is formed as one part and can therefore be actuated by one displacing device. The adjusting wedge has two portions with wedge surface areas inclined in relation to a horizontal plane, which are arranged at a horizontal distance from the two roll chocks and interact with mating wedge surface areas on the lower pressure plates. This ensures that no displacement deviations can occur, as would be possible with two wedges that are independent of each other. The adjusting wedge is horizontally guided on guide bars, whereby lateral deviating movements are prevented. These guide bars are fastened to fixed lower pressure plates. These pressure plates lie directly on the lower crosshead of the stand frame.

The upper pressure plate is fitted in a recess in the roll changing device. It has on opposite sides outwardly extending guide lugs or inwardly extending guide channels, each guide lug or guide channel being guided with three vertical guiding surface areas on three opposite vertical guide bars in the roll changing device. Consequently, during rolling operation, the lower work roll, and possibly also the lower back-up roll, can be supported by the assigned roll chocks directly in a vertical line in the stand frame by means of the upper pressure plates, the adjusting wedge and the lower pressure plates, without the roll changing device thereby being subjected to loads.

According to one possible embodiment, the roll changing device has a number of holding hooks, which protrude into the recess in the roll changing device, engage under the upper pressure plate and, when one adjusting wedge is drawn back into the roll changing position, support the upper pressure plate.

According to an alternative embodiment, the upper pressure plate has a number of holding hooks, which reach over the recess in the roll changing device and, when one adjusting wedge is drawn back into the roll changing position, rest on the roll changing device.

When one adjusting wedge is drawn back into the roll changing position, the two roll chocks rest on the roll changing device and there is a gap between the upper pressure plate and the adjusting wedge and between the upper pressure plate and the roll chock.

Consequently, the wedge adjusting device is structurally separate from the roll changing device and can remain in the rolling stand during the roll changing operation. Only the upper pressure plate, which rests in the roll changing device, is moved out of the rolling stand and back in again during the changing of the roll with the roll changing device.

For fixing its installation position and for taking frictional forces which occur between the adjusting wedge and the upper pressure plate when the adjusting wedge is displaced, the roll changing device is expediently assigned a locking device in the stand upright.

The roll changing device is assigned wheelsets, which are installed in a frame of the roll changing device such that they lie inside it. They are arranged on both sides of the guide lugs or guides channels. This achieves a further reduction in the installation width in the stand frame of the roll stand.

The roll changing device according to the invention with a wedge adjusting device allows a reduction of the structural width by up to 20% and a reduction of the structural height by up to 40% in comparison with known adjusting devices of the same adjusting wedge width.

BRIEF DESCRIPTION OF THE DRAWINGS

Further advantages and features of the present invention emerge from the following description of non-restrictive exemplary embodiments, reference being made to the accompanying figures, in which.

DESCRIPTION OF A PREFERRED EMBODIMENT

Figure 1:
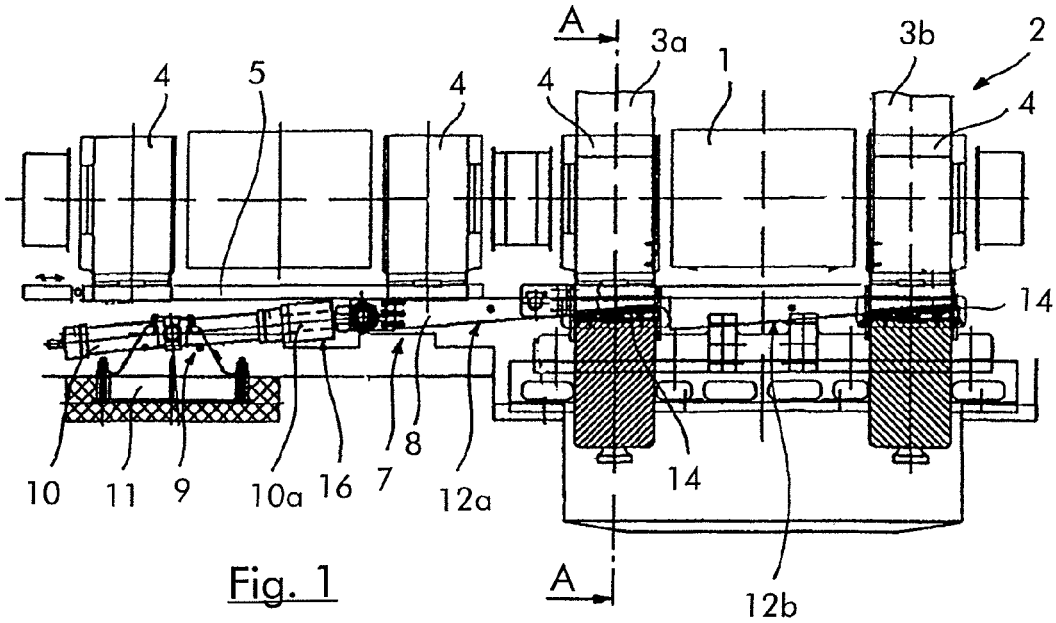
FIG. 1 shows the device according to the invention for changing the height of rolls in a longitudinal section through a rolling stand parallel to the roll axis in a schematic representation.

FIG. 1 schematically shows the lower roll 1, in this specific representation the lower back-up roll, of a four-high rolling stand 2 (substantially not represented any more specifically) in the installation position within the two stand uprights 3*a*, 3*b* and in the roll changing position laterally alongside the rolling stand. The lower roll 1 is rotatably mounted with its end shaft journals in roll chocks 4 and guided in a height-adjustable manner on vertical guides in the windows of the stand uprights 3*a*, 3*b*. The moving of the rolls in and out of the rolling stand takes place with a roll changing device 5, on which the roll is supported by the roll chocks 4. The displacing operation takes place with a pressure-medium cylinder 10 coupled in an articulated manner to the roll changing device.

Figure 2:
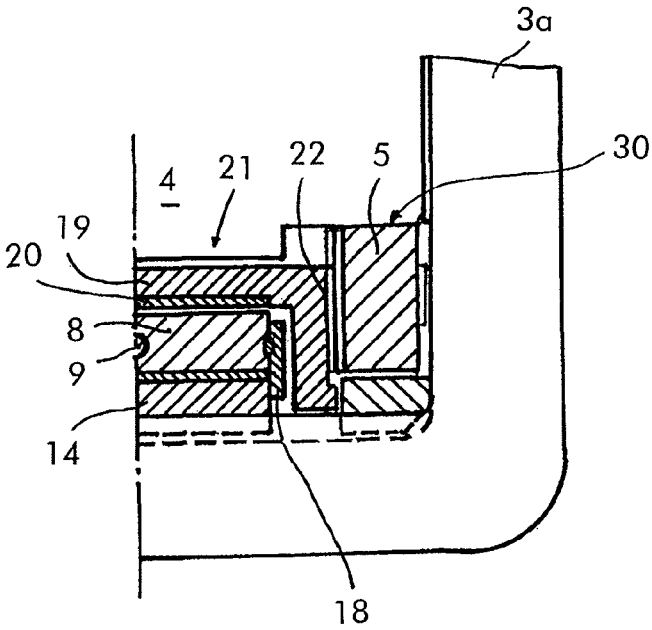
FIG. 2 shows a section through the roll changing device and the wedge adjusting device along the sectional line A-A in FIG. 1.
Figure 4:
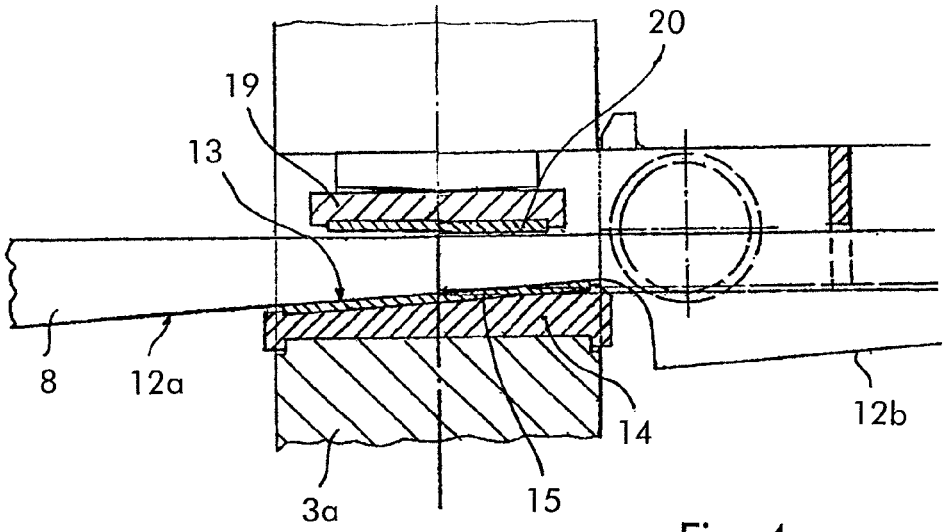
FIG. 4 shows an enlarged fragment of a longitudinal portion of the wedge adjusting device according to the invention.
Figure 3:
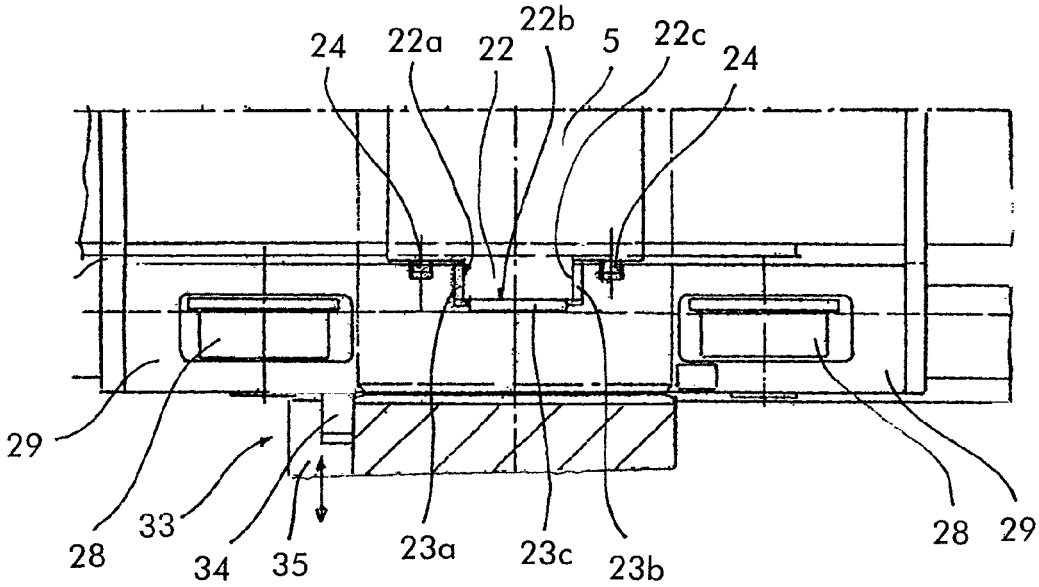
FIG. 3 shows details of the roll changing device according to the invention in a plan view.

As can be seen in detail from FIGS. 2 to 4, the rolls (work rolls or back-up rolls and work rolls together) are steplessly brought into line with the rolling line by a wedge adjusting device 7, which comprises an adjusting wedge 8, which is adjustable in the longitudinal direction of the rolls, and a displacing device 9, which is connected in an articulated manner to the adjusting wedge. The displacing device 9 is formed as a hydraulic pressure-medium cylinder 10 and is pivotably supported on a bracket 11 screwed to the foundation.

The adjusting wedge 8 carries on its underside two wedge surface areas 12*a*, 12*b*, which are inclined in relation to a horizontal plane, have a smooth surface and are arranged at a horizontal distance from the two roll chocks 4. The wedge surface areas are inclined 5% in relation to the horizontal plane. The wedge surface areas 12*a*, 12*b* are supported on mating wedge surface areas 13 of lower pressure plates 14 (FIG. 4). The lower pressure plates 14 are lined with wearing plates 15 and fastened in the stand uprights 3*a*, 3*b*. A horizontal displacement of the adjusting wedge 8 therefore brings about raising or lowering of the roll chocks 4 carrying a roll. The fixing of the adjusting wedge 8 in the target position, in which the work roll forms a tangent to the rolling line, takes place by a clamping device 16, which blocks longitudinal displacement of the adjusting wedge 8. This clamping device 16 may act on the adjusting wedge or on the piston rod 10*a* of the pressure-medium cylinder 10.

The clamping device comprises, for example, prestressed clamping jaws, which, in the case of an intended adjusting movement, can be opened counter to the closing pressure. Horizontal guidance of the adjusting wedge 8 is ensured by lateral guide bars 18, which are screwed onto both sides of the lower pressure plates 14 (FIG. 2).

As represented in FIGS. 2 and 4, arranged between the two roll chocks 4 and the adjusting wedge 8 are upper pressure plates 19, which are lined with wearing plates 20. Each pressure plate 19 is fitted in a recess 21 in the roll changing device 5 and is horizontally and vertically guided therein. These guides take frictional forces when the adjusting wedge is displaced. Arranged for this purpose on opposite sides of the pressure plate 19 are outwardly extending guide lugs 22 with three vertical guiding surface areas 22*a*, 22*b*, 22*c*, which are guided with play on three vertical guide bars 23*a*, 23*b*, 23*c* of the roll changing device 5. Also arranged on the roll changing device 5 are a number of holding hooks 24, which protrude into the recess 21 in the roll changing device, engage under the upper pressure plate 19 and, when one adjusting wedge 8 is drawn back completely into the roll changing position, support the upper pressure plate 19, so that the upper pressure plate 19 is carried by the roll changing device 5. In this position, a gap 26 is formed between the upper pressure plate 19 and the adjusting wedge 8 and a further gap is formed between the upper pressure plate 19 and the roll chock 4. The roll chocks 4 then rest on the roll changing device 5. In this roll changing position that is represented in the figure, with the adjusting wedge 8 drawn back, the roll changing device 5 with the roll chocks 4 and the upper pressure plates 19 resting unattached on the roll changing device can be moved out and then moved back in again with a new roll.

The roll changing device 5 is equipped with wheelsets 28, which are arranged in the frames 29 of the roll changing device under the resting surface areas 30 of the roll chocks 4. The wheelsets 28 are assigned running rails.

The roll changing device 5 is assigned a locking device 33 for fixing in the rolling stand (FIG. 3). This locking device comprises a stop 34 on the roll changing device, opposite which there lies a supporting surface area on the rolling stand, whereby the moving-in movement of the roll changing device is limited. With a puller and pusher mechanism 35, unintended movement back of the roll changing device is prevented and decoupling of the roll changing device from the displacing device is possible during rolling operation.

The invention claimed is:

1. A changing device for changing the height of a roll in a roll stand, wherein the roll stand comprises:

a pair of spaced apart roll stand uprights arranged in parallel, a roll having a pair of roll chocks thereon, the roll chocks being supported on the uprights and the roll thereby being supported by and between the uprights;

the changing device for changing the roll height comprising:

a wedge adjusting device for bringing the roll into line with a rolling line, the wedge adjusting device comprising:

each of the roll chocks being supported on a respective one of the stand uprights for guiding the roll chocks with adjustable height on the uprights;

a roll changing device operable for changing the roll height on the uprights, the roll changing device is movable in the longitudinal direction of the roll;

a respective upper pressure plate supported on the roll changing device and disposed below a part of the respective chock;

a lower pressure plate supported on the stand upright below the upper pressure plate;

an adjusting wedge movable in a space between the upper and lower pressure plates, the adjusting wedge is wedge-shaped in the longitudinal direction of the roll and is displaceable in the longitudinal direction of the roll and with respect to the stand uprights and the pressure plates, the wedge has a continuously planar wedge surface area toward at least one of the pressure plates;

a wedge displacing device connected to the adjusting wedge and operable for displacing the wedge along the longitudinal direction of the roll for selectively causing the wedge to press on the upper pressure plate and raise the chock as the wedge moves to one wedge position or to not support the chock as the wedge moves toward another wedge position so that the chock seats on the roll changing device in the other wedge position;

a clamping device for fixing the adjusting wedge at a position along the longitudinal direction of the roll;

the wedge adjusting device is structurally separate from the roll changing device; and the upper pressure plate is vertically and horizontally guided in the roll changing device.

2. The device as claimed in claim 1, further comprising a pressure-medium cylinder forming the wedge displacing device for operating the adjusting wedge along the longitudinal direction of the roll, and a piston rod of the pressure-medium cylinder; the clamping device acts on the piston rod for fixing the adjusting wedge.

3. The device as claimed in claim 2, further comprising a measuring device operable for measuring linear displacement of the displacing device or the pressure-medium cylinder.

4. The device as claimed in claim 1, wherein the adjusting wedge includes two wedge surface areas along the longitudinal direction of the roll, each surface area arranged at a horizontal distance from a respective one of the two roll chocks, each wedge surface area is inclined in relation to a horizontal plane and a mating wedge surface area on each respective lower pressure plate with which each wedge surface area interacts.

5. The device as claimed in claim 4, wherein each wedge surface area of the adjusting wedge is inclined in relation to the horizontal plane at an angle which lies in the range of self-locking of a resulting wedge connection between the wedge and the pressure plates.

6. The device as claimed in claim 1, further comprising guide bars fastened to the fixed lower pressure plates and the adjusting wedge is horizontally guided on the guide bars.

7. The device as claimed in claim 1, further comprising a recess in the roll changing device into which the upper pressure plate is fitted, the upper pressure plate has opposite sides, outwardly extending guide lugs or inwardly extending guide channels on the sides of the pressure plate, wherein each guide lug or guide channel is guided with three vertical guiding surface areas on three opposite vertical guide bars in the roll changing device.

8. The device as claimed in claim 7, further comprising a plurality of holding hooks of the roll changing device protruding into the recess in the roll changing device, engaging under the upper pressure plate and supporting the upper pressure plate when the adjusting wedge is drawn back into the roll changing position.

9. The device as claimed in claim 7, further comprising the upper pressure plate having a number of holding hooks, which reach over the recess in the roll changing device and rest on the roll changing device when the adjusting wedge is drawn back into a roll changing position.

10. The device as claimed in claim 1, wherein when one adjusting wedge is drawn back into the roll changing position, the roll chocks rest on the roll changing device and a gap is produced between the upper pressure plate and the adjusting wedge and between the upper pressure plate and the roll chock.

11. The device as claimed in claim 1, further comprising a locking device in the stand upright operable for fixing the installation position of the roll changing device.

12. The device as claimed in claim 1, further comprising wheelsets installed in a frame of the roll changing device such that the wheelsets lie inside the frame.

* * * * *